United States Patent [19]

Wolf et al.

[11] Patent Number: 4,662,537

[45] Date of Patent: May 5, 1987

[54] TIMED PILL MONITOR AND DISPENSER

[75] Inventors: James L. Wolf, Lakewood; Alan S. Bardwick, Denver; Daniel V. Sallis, Littleton, all of Colo.

[73] Assignee: Advanced Technology Products, Inc., Lakewood, Colo.

[21] Appl. No.: 621,672

[22] Filed: Jun. 18, 1984

[51] Int. Cl.[4] ..... B65D 85/56; B65D 83/04

[52] U.S. Cl. ..... 221/89; 206/539; 220/305

[58] Field of Search ..... 221/2, 5, 87, 90, 3, 221/8, 89, 267; 206/531, 538, 539; 220/305, 306; 215/292, 363; 604/89, 90, 91; 273/139; 116/308

[56] References Cited

U.S. PATENT DOCUMENTS

| | | | |
|---|---|---|---|
| 327,099 | 9/1885 | Painter | 215/363 |
| 2,317,860 | 4/1943 | Sörensen | 206/531 |
| 2,628,739 | 2/1953 | Vischer, Jr. | 220/305 |
| 3,537,422 | 11/1970 | Moe | 206/539 X |
| 3,651,927 | 3/1972 | Richardson et al. | 221/5 |
| 3,651,984 | 3/1972 | Redenbach | 221/3 |
| 3,807,551 | 4/1974 | Ankney | 206/539 |
| 3,818,473 | 6/1974 | Murray et al. | 340/309.15 |
| 3,968,900 | 7/1976 | Stambuk | 221/3 |
| 3,998,356 | 12/1976 | Christensen | 221/2 |
| 4,057,145 | 11/1977 | Wray et al. | 206/538 |
| 4,074,806 | 2/1978 | Ardito | 221/87 X |
| 4,126,758 | 11/1978 | Krumme | 220/305 X |
| 4,158,411 | 6/1979 | Hall et al. | 206/539 X |
| 4,223,801 | 9/1980 | Carlson | 206/533 X |
| 4,258,354 | 3/1981 | Carmon et al. | 340/309.15 X |
| 4,275,384 | 6/1981 | Hicks et al. | 340/309.15 X |
| 4,364,614 | 12/1982 | Weis et al. | 220/305 X |
| 4,526,474 | 7/1985 | Simon | 116/308 X |

*Primary Examiner*—H. Grant Skaggs
*Assistant Examiner*—Edward S. Ammeen
*Attorney, Agent, or Firm*—Max L. Wymore

[57] ABSTRACT

A portable pill storage and dispensing device adapted to record the time one or more pills are dispensed on demand or emits a time alarm as a reminder which events are recorded for future interrogation and where a novel pill-retaining cavity closure is selectively activated to disperse one or more pills. The device consists of a keyboard assembly which also stores and dispenses the pills and an electronic assembly which records the data regarding key closures whenever a pill is dispensed.

4 Claims, 15 Drawing Figures

TIMED PILL MONITOR AND DISPENSER

FIELD OF THE INVENTION

Description of the Prior Art

In the treatment of certain patients, it is necessary that they take prescribed medicaments at predetermined time intervals or on demand either as a minimum requirement or not to exceed a recommended dosage.

U.S. Pat. No. 4,258,354 is directed to a portable alarm which in a preferred embodiment includes a medicine storage means and actuatable warning devices in the form of visual indicators to indicate when and what particularly medicine is to be taken.

A timer mechanism is set to provide increments of a predetermined length such as one hour and in this instance, 24 one-hour increments are used to provide the timing period between events which are programmed into memory to select one or more of a number of columns that corresponds with a particular compartment in which the pills or capsules are stored. Upon the lapse of the predetermined time period, an alarm either audible or visual is activated and a display is energized to identify the particular columns from which medicine is to be taken. If the alarm is to shut off, it will repeat after a predetermined time interval. The patent identified above does not make any provision for determining when a particular medication has been removed from the compartment.

U.S. Pat. No. 3,818,473 is directed to a personal pill reminder comprising a pill container having a lower pill-holding portion and an upper cover portion. A spring-driven escapement controlled timer projects from an inner face of the cover portion. A battery in the cover portion supplies current to the buzzer when timer contacts are closed and when complementary contacts in the cover and container portions are mated, the buzzer stops when the container is opened. When the container is closed without resetting the timer, the buzzer is again activated reminding the carrier to set the timer. When the timer is set and the cover is closed, the buzzer sounds after a preselected number of hours, reminding the carrier to open the box, take a pill, and reset the timer.

U.S. Pat. No. 4,275,384 is directed to a portable medicine cabinet with timer. This patent is directed to a medicine cabinet having a timer for personal use that may be carried on the person in an attempt to assure that the individual does not become confused or forget to take doses of prescribed medicine. The cabinet has a plurality of compartments therein and a time computer means into which a plurality of time intervals may be entered when such medicine is to be taken. An indicator means is connected to the computer means and provides an indication that the predetermined time intervals have elapsed and further indicates which of the medicines are to be removed from the respective compartments. This patent teaches the use of compartments for holding bottles or containers of medication which compartments have a closure therefor under control of a computerized timer. When a medication is placed in a compartment, the time interval at which the next medication is to be taken is entered into the computer, which after the lapse of the predetermined set time will sound an alarm and indicate which compartment medication is to be taken from and opens the door to that compartment. A plurality of compartments are provided such that a number of medications can be accommodated and the computer can be set for a number of different time intervals which can be applied to a particular compartment.

U.S. Pat. No. 4,223,801 is directed to an automatic periodic drug dispensing system. This device provides for the orderly storage of a number of drugs to be given in a predetermined time period with a coding associated with each pill. Thus, there is provided a timing means to measure and indicate the presence of a lapsed time interval to provide a signal or some other indicia that a pill is to be taken.

U.S. Pat. No. 3,998,356 is directed to an electronic system for article dispensing apparatus. The apparatus is particularly suited for dispensing pills and comprises a plurality of magazines or cassettes, each magazine containing a number of doses of a particular pill prescribed for the patient. The magazines contain a plurality of rotatable compartments for storing several days' supply for a particular patient. Usually a plurality of magazines is inserted into the dispensing apparatus, and then the dispenser is activated to dispense from the magazines those pills required at that time. Various magazines can only be activated at particular times of the day so that a pill cannot be dispensed at the times prescribed for a particular patient. While the patent is of interest, in that dispensing cassettes are taught, the dispensive mechanism includes a separate insertable magazine or cassette and ech magazine has a plurality of movable compartments which when movable disks are aligned such that openings therein register with a particular compartment, a pill is dispensed by dropping through all of the openings into a dispensing container. The compartments are indexed by means of solenoids which step the magazines through a cycle. Of course, the magazines are under the control of an electronic system which supervises and selects the proper dispensing routine.

U.S. Pat. No. 3,651,984 is directed to a pill dispensing device that is clock-actuated and utilizes a drum receptacle for dispensing a supply of pills.

U.S. Pat. No. 3,968,900 is directed to a timed medicant dispensing device which holds several pill containers that contain predetermined numbers of tablets which containers are dispensed to a patient at timed intervals.

U.S. Pat. No. 4,364,614 is directed to a closure member for bearing units including a frangible knockout plug adapted to be broken out of the closure member with an impact tool to provide an aperture allowing removal of the closure member with the tool. The patent utilizes a double curved circular member and which when flexed in the center provides a double bend, the center of which includes the knockout member through which a tool can be inserted for prying release of the closure member.

U.S. Pat. No. 4,126,758 is directed to a method for sealing integrated circuit components with heat recoverable cap and resulting package. The method of sealing components is by positioning a heat recoverable sealing member over the electrical component. When the sealing member is utilized, the metal is in a deformed, unstable martensitic state, and thereafter is allowed to heat recover to a stable, austenitic state. When a plastic material is used, the polymer is heated, deformed and quenched in an unstable state, so upon heating it recovers via its elastic memory to a stable state.

U.S. Pat. No. 4,158,411 is directed to a dispensing package for containing a plurality of individual dosages of pills, capsules, tablets and the like that can be selectively removed, one dose at a time. A cover portion for the package is made up of an outer layer of paperboard or the like with an inner layer of rupturable metal foil or the like bonded to one surface. Disk-shaped punch-out lids are cut into the paperboard layer and are held in position by the foil. A container portion is bonded to the foil and includes a sheet of flexible plastic material formed with a plurality of pockets or blisters. One of the lids overlies each of the pockets and a single dose of pills and the like is contained in each of the pockets. By collapsing one of the pockets against the cover portion, the portion of the foil attached to the associated lid ruptures and separates from the cover portion with the lid so that the pill is pressed through the opening uncovered by the lid.

U.S. Pat. No. 2,628,739 is directed to a container closure in which the closure may be simply and rapidly applied to and removed from the container and in which the closure is free from substantially protuberances, fastening means, and the like. The closure or cover 30 is circular, of greater diameter than the opening 20, and is preferably made of thin, flexible sheet metal of high tensile strength and is made in a manner such that it tends normally to warp to the shape indicated in FIGS. 1 and 6, that is, the exterior surface is convex and the removal of the cover is by means of pulling on handle 34 which increases the convexity in effecting removal. This is somewhat the converse of the proposed invention and relies upon application of forces near the center of the closure rather than at an edge as in the present invention.

U.S. Pat. No. 3,807,551 is directed to a pill dispenser having a plurality of compartments and a plurality of dispensing flaps in a front wall providing access to each compartment.

U.S. Pat. No. 3,537,422 is directed to a dispenser having a body with several spaces or compartments and a cover which is movable step-wise relative to the dispenser body so that the spaces or compartments are uncovered serially.

U.S. Pat. No. 3,269,582 is directed to a closure plug of the expansible type fabricated from a circular disk of resiliently deformable metal or other material having an inwardly-facing surface adapted to face the interior of a bore and an outwardly-facing surface adapted to face a flared entrance to said bore when the plug is installed.

The principal objective of the present invention is to provide an electrically operated device which can be programmed to release predetermined medicaments in a predetermined amount and where the data is stored for future access and verification as described.

A further object of the invention is to provide a novel dispensing arrangement which is actuated by the same mechanism which closes a switch means providing a signal thereof to the electronics.

It is a further objective of the present invention to provide a totally programmable medication system.

A still further objective of the present invention is to provide an electronic recording of the precise times when medicaments are released from their container.

Another object of the present invention is to provide the capability of knowing which medicament was released at each specific time as opposed to merely that a medicament was released.

A still further objective of the present invention is to provide a combination medicament package and a timing package such that medicaments cannot be removed without the medicament package being connected to the electronics.

A further object of the invention is to provide a remember feature with the ability to recognize when the medicament has been released and provide a warning if it is not the correct time or if the incorrect medicament has been selected.

Another object of the invention is to provide the ability through function buttons to display when a previous medicament was released or when the next usage is to be taken.

A further important object of the present invention is to provide a relatively inexpensive system with LCD readout.

A still further object of the present invention is to provide an improved timed pill monitor and dispenser that overcomes the disadvantages of the prior art devices.

SUMMARY OF THE INVENTION

The device consists primarily of an electronics module and a keyboard pill dispensing module. The electronic module preferably has a digital display means which normally displays the day and the date. In addition, the electronics module includes a microcomputer circuit to control the operation of the device.

The keyboard module provides storage space for individual tablets or pills. In addition, the keyboard module incorporates an electrical switch for each key pad which on closure indicates to the microcomputer that a tablet has been dispersed. Additional key pads may also be provided that do not dispense tablets but provide means to interrogate the use of the device by a patient to determined such things as when the next pill is to be taken, when the last pill was taken, how many pills are left, when the device is to be refilled, or similar functions.

The keyboard module also incorporates a lock-out function to disable the keyboard when the device is not in use. This prevents accidental pill dispensing as well as unintentional switch closure while the keyboard is in the inactive mode.

The device operates as follows: initially the pill monitor is supplied without pulls. The monitor is loaded by introducing the proper pills and number within the plurality of cavities in the keyplate corresponding to the key pads aligned therewith. Each cavity is then closed by a cover disk and the keyplate fitted into the frame to complete the loading operation.

Normally, the electronics module will require initialization before use. Initialization is accomplished by disengaging the electronics module from the monitor and then plugging the module into a separate translating unit, a microcomputer program may be then transferred from the translator to the memory of the microcomputer within the electronics module. The electronics module is then reconnected to the keyboard module and the monitor is then ready for use.

Once the monitor has been loaded and initialized, it may be used in several ways. It may be used as a monitor and recording means to determine how often a patient uses a particular type of medication, on a demand basis. It may also be used as a reminder and recording device to determine patient compliance with a prescribed regimen of administering the medication. The monitor may also be used as a combination of the two and the selection of the mode or combination of operation is determined at the time of programming during initialization.

Visual and/or audible means are provided for alerting the user under control of the stored program. The monitor also includes a crystal-controlled timer which is capable of informing the microcomputer of the correct time of day, the date and/or whether a preset time interval has elapsed.

Under normal conditions, the microcomputer causes the display to show the time and date. If the monitor is programmed for "monitor" mode, then whenever a tablet is dispersed, the time and date will be stored as data in the memory of the monitor. If the monitor is programmed for "reminder" mode, then the alarm will be activated whenever it is time to administer medication. In addition, the microcomputer will at this time cause the display to indicate which key to press to dispense the correct tablet. The alarm will deactivate only if the indicated medication is dispensed at the appointed time.

The monitor is programmed for various modes of operation. If the user presses a key that has already dispensed its tablet, this action is not recorded. If the incorrect key is pressed which dispenses an incorrect tablet or, if a tablet is dispensed at the wrong time, the monitor will activate an alarm to signal the user not to take the medication incorrectly dispensed. Also, if medication is not dispensed within an alotted time period, the alarm will be energized, or the monitor may reprogram this tablet for a different time. In addition, the monitor may be programmed to record which tablet id dispensed as well as the time and date.

Data regarding key closures and their respective times and dates is stored in the memory of the monitor until the monitor is reinitialized. The internal memory in the monitor is capable of storing a large number of events and times, so that a patient's prescription may be refilled several times before the memory of the monitor may be accessed only by means of the translator, so that the monitor is protected from tampering. The monitor would be returned to the patient's physician when the patient had taken all of the pills, well in advance of the monitor memory being full. The electronics module would be disconnected from the keyboard and plugged into the translator. The translator is a separate device which is able to read the data stored as code and translate this code into readable form. The translator will also, on demand, provide a printed hard copy of the logged events data of the monitor. Also, the translator provides certain diagnostic functions which automatically maintains the reliability of the electronics of the monitor, e.g. low battery condition, memory errors, and monitor not calibrated. The translator is also used to clear the memory of the monitor and restart the internal clock to a predetermined setting, so that the monitor may be reloaded and used again.

The mechanism employed by the monitor for the dispensing of pills is that of a disk of a slightly larger diameter than the diameter of a cavity receiving a pill. A thin, flat circular disk of flexible resilient material of a slightly larger diameter than the cavity is pressed into the cavity positioned normal to the axis of the cavity. When enough pressure is applied to the center of the disk, the disk will bow in the same direction as the applied force, until the disk will fit the hole. When the pressure is removed, the disk will remain bowed due to the stress created by the interference fit. Assuming that both the disk and the cavity are perfectly round, the stress force will be equally distributed radially about the circumference of the disk. If pressure is applied at or near the center of the disk, the force required to remove the disk is very great, due to the fact that additional effort must be expended simply to overcome the static equilibrium of the stress forces already imparted to the disk by forcing it into the hole. In fact, pressure applied normal to the disk at its center tends to seal the cavity more tightly.

If, however, pressure is applied near the edge of the disk, then very little force is required to remove the disk. This is due to the fact that the longer moment-radius will provide additional leverage. Pressure applied at a point near the edge of the disk contributes to the existing stress-forces, causing additional distortion of the disk. As the magnitude of distortion increases, the chord length of the diameter of the disk decreases. Simultaneously, the point at which pressure is being applied is forced beyond the edge of the hole. The stresses within the disk are no longer held in static equilibrium. With the stress partially relieved at one point the static balance of forces begins to decay, releasing energy stored within the disk when it was distorted to fit the hole. The natural tendency of the disk to resume its original, undistorted shape releases enough energy to forcibly expel the disk from the hole.

DESCRIPTION OF THE PREFERRED EMBODIMENT

Figure 1:
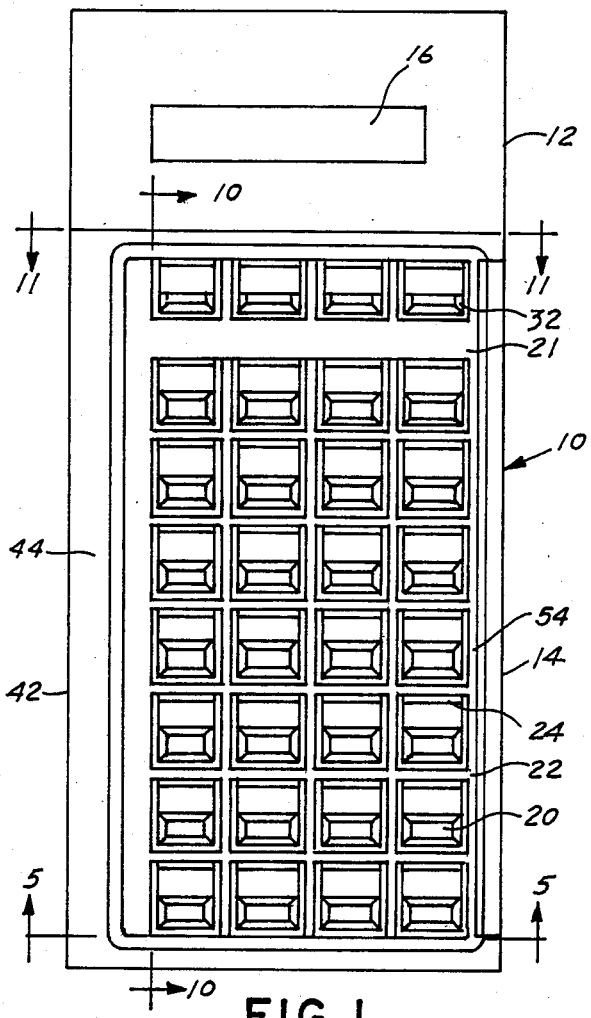
FIG. 1 is a top plan view of the timed pill monitor and dispenser according to the invention.

The timed pill monitor 10 according to the present invention includes an electronics module 12 and a keyboard pill dispensing module 14. The electronics module preferably has a visual display 16 which normally displays the day and the date. The electronic module contains a microcomputer to control the operation of the dispenser and is connected to the keyboard module by means of a multi-pin connector 15 illustrated in FIG. 11

Figure 3:
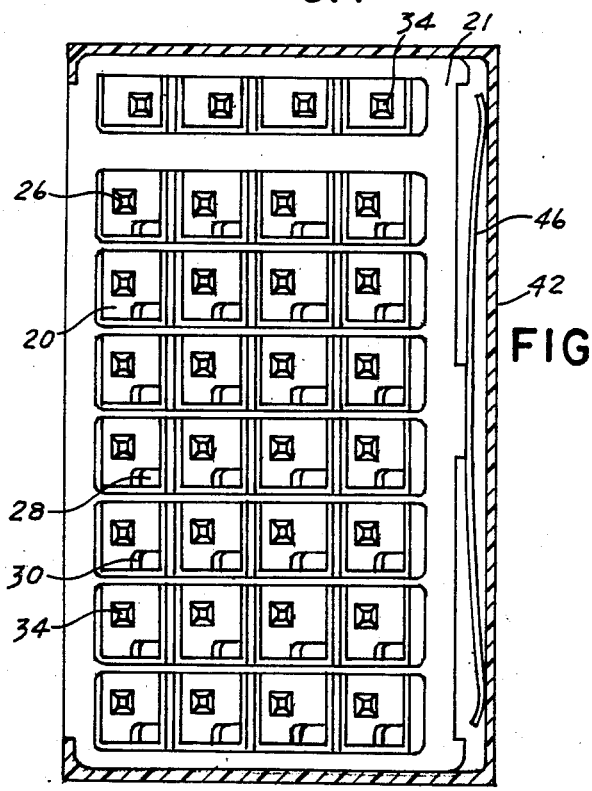
FIG. 3 is a cross sectional view thereof along line 3—3 of FIG. 10.
Figure 4:
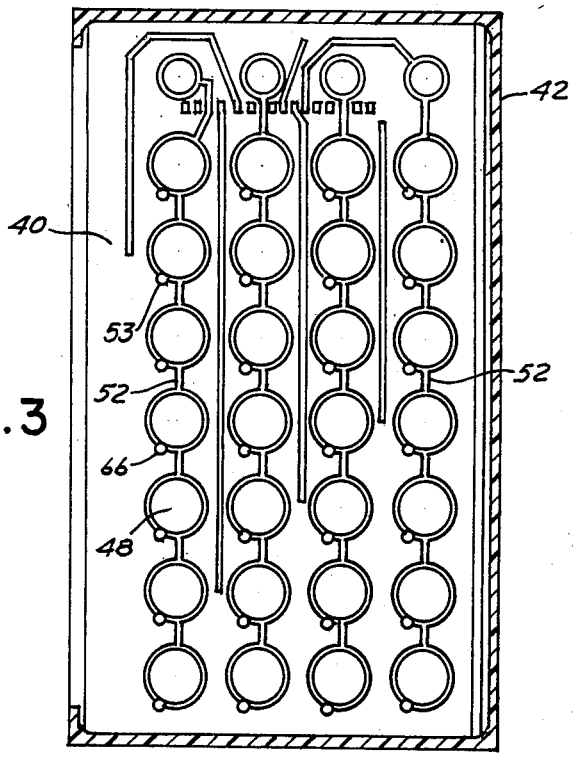
FIG. 4 is a cross sectional view thereof along line 4—4 of FIG. 10.
Figure 5:
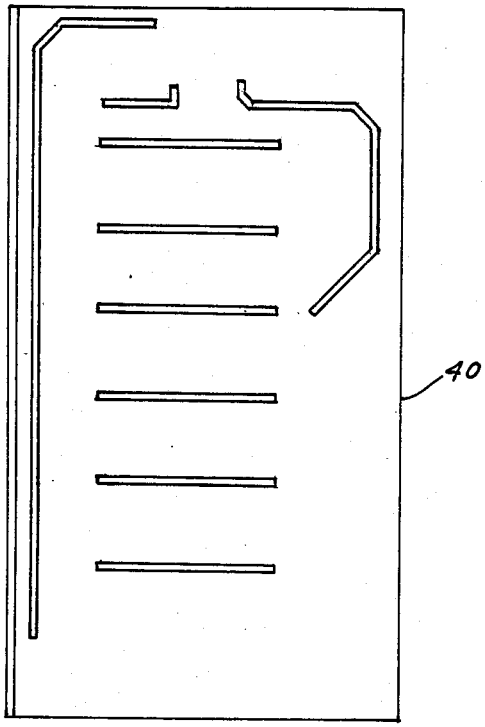
FIG. 5 is a plan view of the reverse side of the circuit board of FIG. 4.

The keyboard 14 is provided with a top 21 containing a plurality of keys or buttons 20 hinged to a surrounding frame 22 by means of a flexible web 24. The bottom of the keyboard, FIG. 3, is provided with a raised portion 26 near the center of the key. Each key is also provided on the bottom with a recess 28 located near the lower right-hand corner which is provided with a sloped portion 30, sloping downwardly from left to right in the drawing. The keyboard may also be provided with function keys 32 which may also be provided on the bottom thereof with raised portions 34. The keys or buttons coact with an actuator means 66 and a switch means 48 to dispense medication and to send data to the electronic module. The base 36 of the keyboard module is provided with a plurality of openings or cavities 38 which are indexed with the keys 20 and into which cavities the medication to be dispensed is placed when loaded. The keyboard module 14 is made up of a top 21 and a bottom 36 and a printed circuit board 40 sandwiched between the top 21 and the bottom 36, with FIG. 4 showing the top of the PC board which is positioned against the underside of the keyboard 21 shown in FIG. 3 while FIG. 5 shows the bottom of the PC board which is positioned against the top surface of the bottom 36 of the keyboard module.

Figure 11:
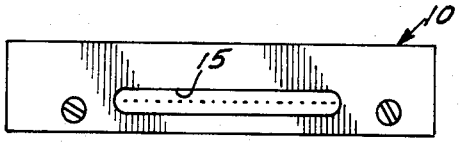
FIG. 11 is an end view of the keyboard module along line 11—11 of FIG. 1.
Figure 12:
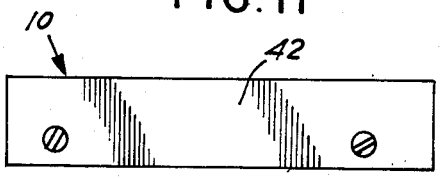
FIG. 12 is the opposite end view of the keyboard module of that of FIG. 11.

A C-shaped frame 42 having an inturned flange 44 is secured to the bottom 36 by means of screws 37 and 39, FIGS. 11 and 12, with the keyboard 21 being received under the flange 44 for slidable movement against a spring 46 acting between the closed side of the C-shaped frame and the adjacent side of bottom 36. This permits the keyboard 21 to be translated sideways to effect positioning thereof from a locked status to an unlocked status.

The top of the printed circuit board 40 is provided with a plurality of printed circuit spring switches 48, such as a dome switch, having a convex top spring loaded contact which is in the normally-open state and is closed on being depressed to complete circuits through traces 52 via grommets 53. The switches are connected into appropriate electronic circuitry to accomplish the objectives of the invention. Printed circuit traces 50 are provided on the opposite side of the PC board to operatively connect them to complete the appropriate circuits of the electronics module 12.

Figure 8:
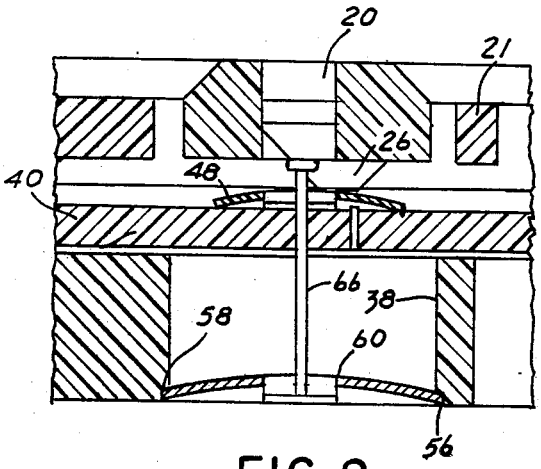
FIG. 8 is a cross sectional view along line 8—8 of FIG. 13 with portions broken away to conserve space, of the keyboard module showing one push button before the button is depressed.
Figure 9:
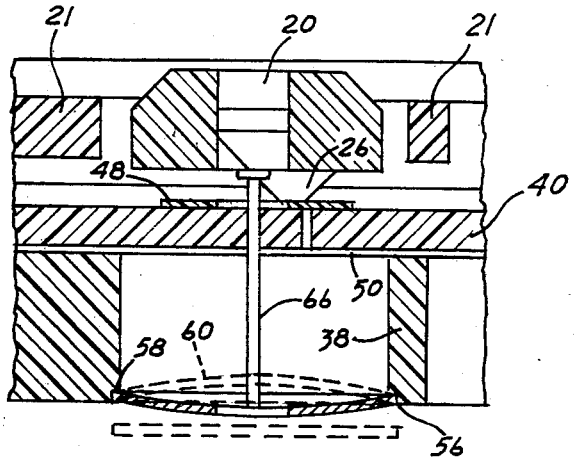
FIG. 9 is a cross sectional view along line 9—9 of FIG. 13, with portions broken away to conserve space, of the keyboard module showing one push button fully depressed and releasing the contents of the associated cavity.
Figure 10:
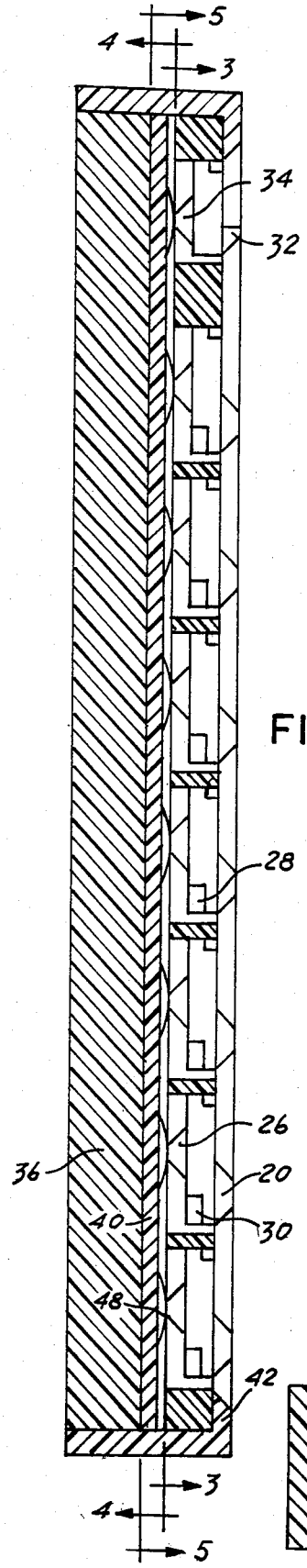
FIG. 10 is a cross sectional view along line 10—10 of FIG. 1.

The dispensing of pills by the monitor is accomplished in a unique manner and one such arrangement therefore is shown. The base 36 is provided with a plurality of circular cavities or bores 38 machined therein corresponding to each key switch 48. FIGS. 1, 2, 3, 4, 6 and 7 show the dispenser in an inoperative or locked state. FIGS. 8 and 9 show the dispenser in an unlocked state ready for dispensing a pill from the respective cavity. Above the base 36 is a printed circuit or PC board 40 which carries the dome switch 48. The dome switches are firmly fixed to the PC board but the tops are free to flex when pressed and engaged by the respective key 20 and its associated raised portion 26. A sheet of plastic may be positioned between the PC board 40 and the base 36 to insulate one from the other. The keys are an integral part of the keyplate 54 made up of frame 22 and keys 20. The keys are secured to the plate 54 by a flexible web 24 along one side of each key. The bottom opening of each cavity 38 has a partial bore 56 of a slightly larger diameter than the cavity 38 providing a shoulder 58 around the bottom rim of each cavity. A cover disk 60 is provided of just slightly larger diameter than the diameter of the partial bore 56. The cavity normally holds a tablet or capsule to be dispensed. The disk cover is pressed into the partial bore 56 against the shoulder 58 to assume a concave shape holding the cover 60 in and against the periphery of the partial bore 56. The bore 38 and partial bore 56 are bored into a rigid material such that the hole of the partial bore is of a slightly smaller diameter than the diameter of the disk cover 38. When enough pressure is centrally applied to the disk cover 38 normal to the surface of the disk, the disk will bow or assume a concave shape and will be force fit into the partial bore. When the pressure is removed, the disk will remain bowed due to the stress created by the interference fit. If the hole and disk are perfectly round, the stress-force will be evenly distributed radially about the circumference of the disk. If a pressure is applied to the top or convex side of the disk to dislodge the disk at or near the center of the disk, the force required is very great due to the fact that additional energy must be expanded simply to overcome the static equilibrium of the stress forces imparted to the disk by forcing it into the hole. If pressure is applied at or near the center of the convex side of the disk, the force required to remove the disk is very great. Further, pressure applied normal to the disk at its center tends to seal the cavity more tightly.

It has been found, however, that if pressure is applied to the top of the disk near the edge thereof, that very little force is required to remove the disk. This is due in part to the fact that the longer moment-radius will provide additional leverage. Pressure applied at a point near the edge of the disk contributes to the existing stress-forces, causing additional distortion of the shape of the disk. At the same time, the point at which pressure is being applied eventually is forced beyond the edge of the hole. Now the stresses within the disk are no longer held in static equilibrium. Since the stress has been partially relieved at one point, the static balance of forced begins to decay, releasing energy stored within the disk when it was distorted to fit the hole. The natural tendency of the disk to resume its original, undistorted shape released enough energy to forcibly expel the disk from the hole.

Figure 2:
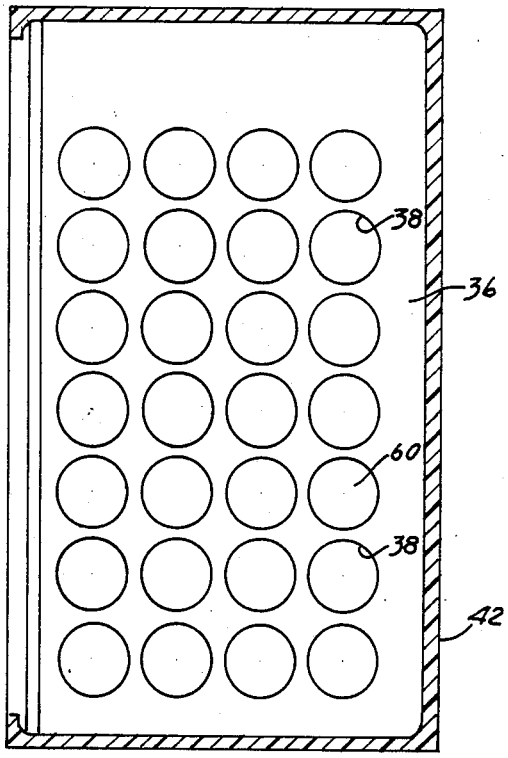
FIG. 2 is a bottom plan view thereof.
Figure 6:
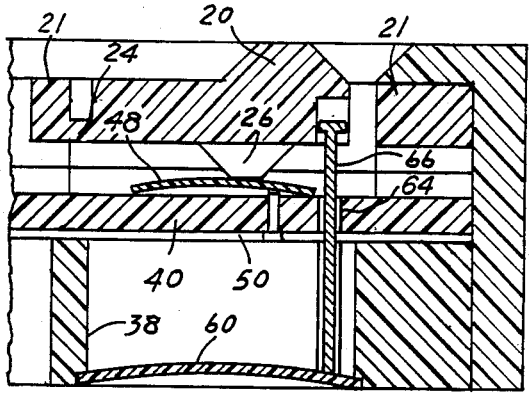
FIG. 6 is a cross sectional view along line 6—6 of FIG. 13 with portions broken away to conserve space, of the keyboard module showing one push button before the button is depressed.
Figure 7:
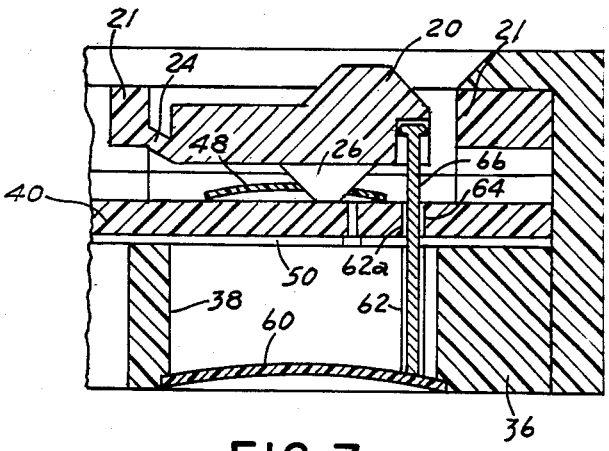
FIG. 7 is a cross sectional view along line 7—7 of FIG. 13 with portions broken away to conserve space, of the keyboard module showing one push button attempted to be depressed with the keyboard in locked position.
Figure 13:
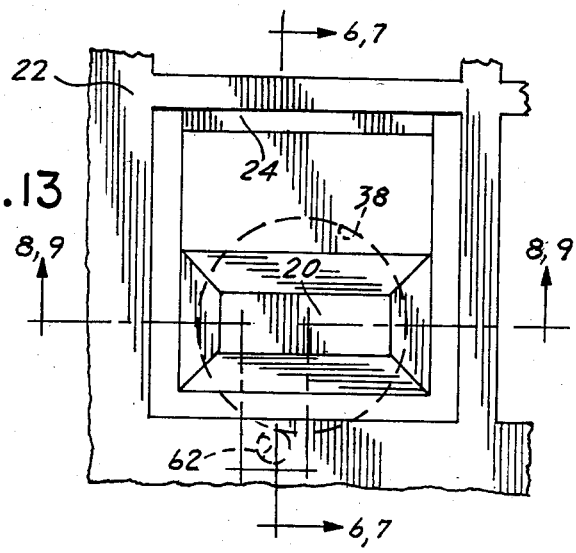
FIG. 13 is a plan view of one key or button of the keyboard, with portions broken away to conserve space showing vertical alignment of the elements with the key or button being in the locked or inoperative position.
Figure 14:
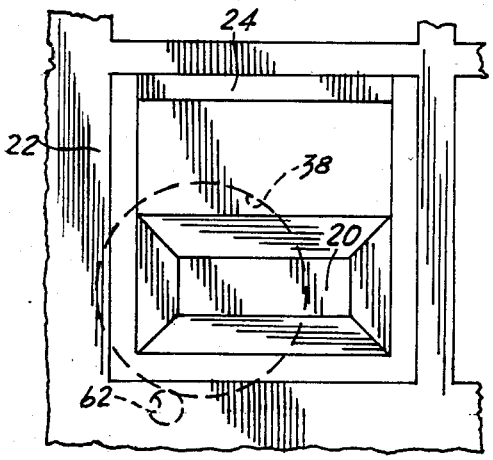
FIG. 14 is a plan view of one key or button of the keyboard, with portions broken away to conserve spacing showing vertical alignment of the elements with the key or button being in unlocked or operative position; and, FIG. 15 is a cross sectional view along line 15—15 of FIG. 1.
Figure 15:
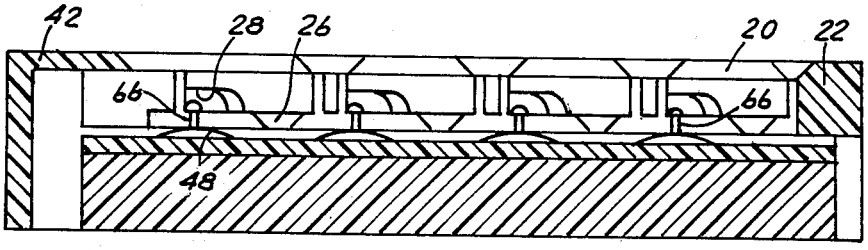

Referring to FIGS. 6–9, there is shown in FIG. 6 a view along line 6—6 of FIG. 13 with the C-shaped frame 42 in retracted position as shown in FIG. 3 and the buttons 20 are prevented from actuating the corresponding switch 48 or engaging trigger or rod 66. When the C-shaped frame 42 is actuated and compressed against spring 46, the keyboard top 21 is moved to the right to an unlocked position and the buttons 20 are in an unlocked position as shown in FIGS. 8 and 9. A bore 62 is drilled through the base 36 with a bore 64 aligned therewith drilling through the PC board 40 and just outside the dome switch 48 to intersect with the shoulder 58 of the cavity 38. A rod 66 is positioned to pass through bores 62 and 64 with the lower end thereof being in contact with the disk 60 near the edge thereof. The upper end of rod 66 is received within the recess 28 on the underside of switches 20 such that with the top 21 of the keyboard 22 in the locked position, the depression of a key 20 will not engage the top of rod 66 and thus will not dislodge a corresponding disk cover 60. At the same time the raised portion 34 on the underside of each key is displaced sideways with respect to the dome switch 48 to be out-of-register therewith such that the switch is not engaged on the depression of a key 20. Thus, in the locked position as depicted by FIGS. 1 and 2, the electronics are protected from actuation and the pill dispenser is prevented from being actuated.

When the dispenser 10 is held in the hand of the user and the C-shaped frame 42 is squeezed against the bias of spring 46, the key board 14 moves relative thereto such that the raised portion 34 on the underside of each key is operatively aligned with the center of the dome switch 48. In addition, the recess 28 will be moved such that the top of of rod 66 will not be received therein such that the underside of the key 20 engages the top of rod 66 on depression applying a force to the edge of the disk 60 to dislodge same, dispensing a pill or capsule. At the same time the corresponding dome switch 48 is closed and registers such closure in the electronics of module 12.

Theoretically, the principle of the invention may be applied to shapes other than round holes and disks, although the circular configuration is preferred, as the complexity of the system of forces involved rapidly increases with more complicated shapes; however, a refinement of the basic design may be included in the mechanism as incorporated in the invention. It will be seen that where a round disk has been pressed into an oblate-circular hole, the interference of the fit will be partially relieved so that the stress-forces are no longer equally distributed but are nevertheless able to achieve static equilibrium. It may be readily observed that in this configuration the magnitude of the stress-forces created is now largest along the shorter diameter. The amount of distortion is also greater along this same diameter. By relieving the fit, thus concentrating the stress-forces along one diameter, the amount of pressure required to remove the disk is further reduced. This is partly due to the fact that the total magnitude of stress is somewhat less, but is primarily because the point at which pressure is applied now coincides with the line-of-action of the principal component of the stress-forces, so that effects of other components of the stress-forces become negligible by comparison.

While there has been described what at present are considered to be the preferred embodiments of the invention, it will be obvious to those skilled in the art that various changes and modifications may be made therein without departing from the invention. It is aimed therefore, in the appended claims to cover all such changes and modifications which fall within the true spirit and scope of the invention.

What is claimed is:

1. A dispenser comprising:

a base plate having a width, a length, a top and a bottom defining a thickness with a plurality of bores therein extending from the top to the bottom adapted to receive a pill or capsule therein;

disk-shaped closure means frictionally held and positioned within each of said bores adjacent the bottom thereof adapted to be selectively removed from the bores to discharge an associated pill or capsule;

the closure means being relatively thin disk-shaped means of a diameter slightly greater than the diameter of the respective bore which disk-shaped means is pressed into the bottom of said bores by applying a force near the center of the disk-shaped means to cause the center portion of the disk-shaped means to flex upwardly sufficient to be received and seated within the bore;

trigger means adapted to apply a concentrated force to said disk-shaped means in a direction immediately adjacent the periphery of said disk-shaped means, to unseat the closure means from the bore and dispense a pill or capsule contained therein;

the trigger means comprising elongated pin means positioned adjacent the circumference of each bore adapted to contact the disk-shaped means near an edge thereof; and, the bores being provided with a counterbore of only slightly larger diameter at the bottom thereof forming a shoulder against which the edge of the disk-shaped means is positioned and a trigger bore parallel thereto being provided adjacent to the bores opening onto said shoulder to engage the disk-shaped means near the periphery thereof to apply a force thereto to dislodge the disk-shaped means from the bottom of the respective bore.

2. A combination pill and capsule dispenser which comprises:

a base plate having a width, a length, a top and a bottom defining a thickness with a plurality of bores extending through the thickness of the base adapted to receive a pill or capsule therein;

disk-shaped closure means frictionally held and positioned within said bores adjacent the bottom, said closure means being of a diameter slightly greater than the bores which closure means is pressed into each bore by applying an upwardly force near the center of the closure means until the disk-shaped closure means assumes a concave shape and assumes a size shaped to be received into the bore;

elongated trigger means extending from the bottom of each bore to the top and positioned adjacent the circumference of each bore adapted to contact the closure means near the periphery thereof;

a keyboard having a plurality of keys positioned on top of the base plate with each of the keys of the keyboard overlaying the top of a respective one of the bores; and, a switch holder having a plurality of pressure sensitive electrical switches with the switch holder being sandwiched between the base plate and the overlaying keyboard, said each of the keys being associated with a different one of the electrical switches, with each key of the keyboard, upon being pressed, activating the associated electrical switch, said associated electrical switch generating a signal and engaging the trigger means to dislodge the disk-shaped closure means and to dispense a pill or capsule contained within the respective bore.

3. The combination of claim 2 where the bores are provided with a counter bore of slightly larger diameter at the bottom thereof forming a shoulder against which the edge of the closure means is positioned and a parallel trigger bore provided adjacent to the bores opening onto the shoulder to engage the closure means near the periphery thereof to apply a force thereto to dislodge the closure means from the bottom of the respective bore.

4. The combination of claim 2 including a spring positioned between a frame connected to the base plate and the keyboard, wherein the keyboard is adapted to be moved from side to side from a locked position to an unlocked position against the spring bias that normally holds the keyboard in a locked position where each key is provided on the underneath thereof with a centrally located protrusion means that is normally misaligned to avoid activating the associates electrical switch and is further provided with a recess means on the underneath thereof adapted to normally receive an upper end of the trigger means such that when the keyboard is in the normal locked position, depressing a key will neither activate a switch nor engage a trigger means and a pill or capsule will not be dispensed, whereupon movement of the keyboard sideways to an unlocked position, causes the protrusion means on the underneath of the key to be positioned to activate the associated electric switch and the recess means is positioned to no longer receive the upper end of the trigger means such that when the key is depressed, the trigger means associated with the underneath of the key is pressed against the disk-shaped closure means causing same to be ejected and a pill or capsule to be dispensed from the respective bore.

* * * * *